US009471011B2

(12) United States Patent
Kikuchi et al.

(10) Patent No.: US 9,471,011 B2
(45) Date of Patent: Oct. 18, 2016

(54) IMAGE FORMING APPARATUS TRANSFERRING TONER IMAGE ONTO SURFACE LAYER PORTION OF INTERMEDIATE TRANSFER MEDIUM

(71) Applicant: KYOCERA Document Solutions Inc., Osaka-shi, Osaka (JP)

(72) Inventors: Einosuke Kikuchi, Osaka (JP); Akira Matayoshi, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 15/013,864

(22) Filed: Feb. 2, 2016

(65) Prior Publication Data

US 2016/0223953 A1 Aug. 4, 2016

(30) Foreign Application Priority Data

Feb. 4, 2015 (JP) ..... 2015-020081
Feb. 4, 2015 (JP) ..... 2015-020082

(51) Int. Cl.
*G03G 15/01* (2006.01)
*G03G 15/16* (2006.01)

(52) U.S. Cl.
CPC ..... *G03G 15/1605* (2013.01)

(58) Field of Classification Search
CPC ..... G03G 15/1605; G03G 15/1625
USPC ..... 399/302
See application file for complete search history.

(56) References Cited

FOREIGN PATENT DOCUMENTS

JP 2003270962 A 9/2003

*Primary Examiner* — David Bolduc
*Assistant Examiner* — Barnabas Fekete
(74) *Attorney, Agent, or Firm* — Alleman Hall McCoy Russell & Tuttle LLP

(57) ABSTRACT

An image forming apparatus includes: a photosensitive body including a photosensitive layer having a first end and a second end, the first end having a larger thickness than the second end; a charging portion charges the photosensitive layer; a light irradiation portion applies light to the photosensitive layer; a developing device develops by toner charged with the same polarity as charge polarity of the photosensitive layer; an intermediate transfer medium including a surface layer having a third end and a fourth end, the third end having a larger thickness than the fourth end, the third end being opposed to the second end, the fourth end being opposed to the first end; and a transfer portion transfers a toner image developed on the photosensitive layer, onto the surface layer when a voltage having polarity opposite to the charge polarity is applied to the transfer portion.

12 Claims, 8 Drawing Sheets

FIG. 10

| PRINCIPAL COMPONENT OF FRONT LAYER PORTION 361B | MARTENS HARDNESS | AMOUNT OF WEAR AT TIME OF PRINTING 200 THOUSAND SHEETS (NON-PROVIDED SIDE) | AMOUNT OF WEAR AT TIME OF PRINTING 200 THOUSAND SHEETS (GEAR-PROVIDED SIDE) |
|---|---|---|---|
| PI (POLYIMIDE RESIN) | ABOUT 180 $N/mm^2$ | ABOUT 2.5 $\mu m$ | ABOUT 4.0 $\mu m$ |
| AC (ACRYLIC RESIN) | ABOUT 250 $N/mm^2$ | ABOUT 0.1 $\mu m$ | ABOUT 0.2 $\mu m$ |

IMAGE FORMING APPARATUS TRANSFERRING TONER IMAGE ONTO SURFACE LAYER PORTION OF INTERMEDIATE TRANSFER MEDIUM

INCORPORATION BY REFERENCE

This application is based upon and claims the benefit of priority from the corresponding Japanese Patent Application No. 2015-020081 filed on Feb. 4, 2015, and No. 2015-020082 filed on Feb. 4, 2015, the entire contents of which are incorporated herein by reference.

BACKGROUND

The present disclosure relates to an image forming apparatus capable of forming an image by electrophotography.

An image forming apparatus, such as a printer, which is capable of forming an image by electrophotography is known. In the image forming apparatus, a photosensitive layer portion of an image carrier such as a photosensitive drum is charged by a charging portion such as a charging roller. On the photosensitive layer portion of the image carrier that has been charged by the charging portion, an electrostatic latent image is formed by light applied thereto from a light irradiation portion. Then, the electrostatic latent image formed on the photosensitive layer portion of the image carrier is developed, for example, by toner that is supplied from a developing unit and charged with the same polarity as the charge polarity of the photosensitive layer portion. Thereafter, the toner image developed by the developing unit is transferred onto a transfer target medium by a transfer portion, such as a transfer roller, to which a voltage having polarity opposite to the charge polarity of the toner is applied. As the photosensitive layer portion of the image carrier, a photosensitive material is coated on a base portion. As a method for coating the photosensitive material onto the image carrier, a dipping method or a ring coating method is known.

Meanwhile, the toner image formed on the photosensitive layer portion of the image carrier may be transferred onto an intermediate transfer belt, which is the transfer target medium, by the transfer portion. The intermediate transfer belt includes a base layer portion and a surface layer portion. For example, the base layer portion is formed of a thermoplastic resin, and, as the surface layer portion, a thermosetting resin which is a surface layer material is coated on the base layer portion. As a method for coating the surface layer material onto the intermediate transfer belt, a dipping method or a ring coating method is known.

In addition, in such a type of an image forming apparatus, the toner image formed on the intermediate transfer belt is transferred from the intermediate transfer belt to a sheet by the transfer roller. For example, the transfer roller is provided at a position opposing a driving roller, which causes the intermediate transfer belt to run, so as to be in contact with the intermediate transfer belt. Moreover, the transfer roller is biased toward the driving roller in order to obtain, at a nip portion formed between the transfer roller and the intermediate transfer belt, a nip pressure required for transfer. Here, the transfer roller can be rotationally driven by a driving force transmitted from the driving roller via a first gear provided on a rotation shaft of the driving roller and a second gear provided on a rotation shaft of the transfer roller.

SUMMARY

An image forming apparatus according to one aspect of the present disclosure includes an image carrier, a charging portion, a light irradiation portion, a developing portion, an intermediate transfer medium, and a transfer portion. The image carrier is provided so as to be rotatable upon reception of a driving force and includes a photosensitive layer portion having a first end portion at one side in a rotational axis direction and a second end portion at another side in the rotational axis direction. The first end portion has a larger layer thickness than the second end portion. The charging portion is configured to charge the photosensitive layer portion at a potential having predetermined polarity. The light irradiation portion is configured to apply light to the photosensitive layer portion charged by the charging portion, to form an electrostatic latent image thereon. The developing portion is configured to develop the electrostatic latent image formed on the photosensitive layer portion, by toner charged with the same polarity as the predetermined polarity. The intermediate transfer medium includes a surface layer portion having a third end portion at one side in a width direction which is the same as the rotational axis direction and a fourth end portion at another side in the width direction. The third end portion has a larger layer thickness than the fourth end portion and is opposed to the second end portion of the photosensitive layer portion. The fourth end portion is opposed to the first end portion of the photosensitive layer portion. The transfer portion is opposed to the image carrier across the intermediate transfer medium and configured to transfer a toner image developed on a surface of the photosensitive layer portion, onto the surface layer portion of the intermediate transfer medium when a voltage having polarity opposite to the predetermined polarity is applied to the transfer portion.

An image forming apparatus according to another aspect of the present disclosure includes a driving roller, an image conveying portion, a transfer roller, a first gear, and a second gear. The driving roller is configured to rotate upon reception of a driving force. The image conveying portion includes a surface layer portion which supports a toner image thereon, is formed such that a layer thickness of the surface layer portion is larger at a first end portion at one side in a rotation shaft direction of the driving roller than at a second end portion at another side in the rotation shaft direction, and is conveyed by the driving roller in a predetermined direction. The transfer roller is provided at a position opposing the driving roller across the surface layer portion of the image conveying portion, is brought into contact with the surface layer portion in a state where a contact pressure against the first end portion side on the surface layer portion is higher than a contact pressure against the second end portion side on the surface layer portion, and is configured to transfer the toner image supported on the surface layer portion, onto a transfer target medium passing through a nip portion formed between the surface layer portion and the transfer roller. The first gear is provided at the first end portion side of the driving roller and configured to receive a rotational driving force transmitted from the driving roller. The second gear is provided at the first end portion side of the transfer roller and configured to transmit the rotational driving force transmitted via the first gear, to the transfer roller.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Further-more, the claimed subject matter is not limited to implementations that solve any or all disadvantages noted in any part of this disclosure.

BRIEF DESCRIPTION OF THE DRAWINGS

FIG. 10 is a diagram showing the results of an experiment using the image forming apparatus according to the second embodiment of the present disclosure.

DETAILED DESCRIPTION

First Embodiment

Hereinafter, a first embodiment of the present disclosure will be described with reference to the accompanying drawings in order to allow understanding of the present disclosure. It should be noted that the following embodiment is an example embodying the present disclosure and does not limit the technical scope of the present disclosure.

[Schematic Configuration of Image Forming Apparatus 10]

First, the configuration of an image forming apparatus 10 according to the first embodiment of the present disclosure will be described with reference to FIG. 1. Here, FIG. 1 is a schematic cross-sectional view showing the configuration of the image forming apparatus 10.

Figure 1:
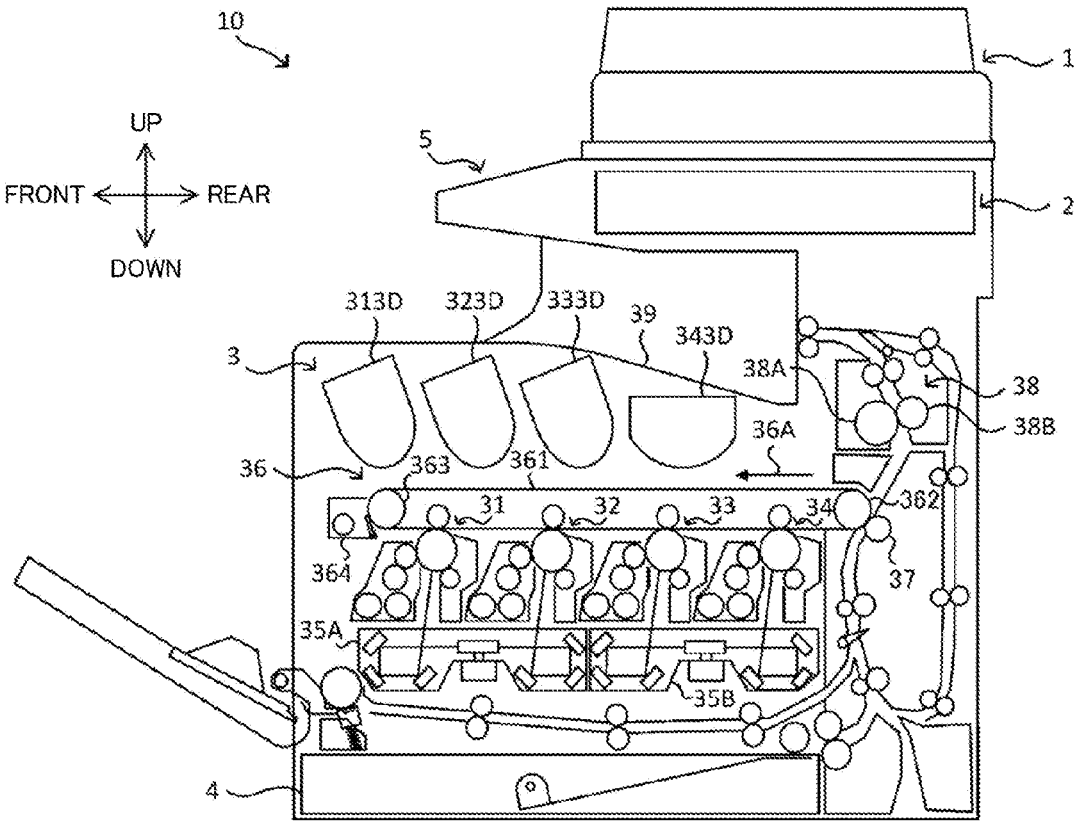
FIG. 1 is a diagram showing the configuration of an image forming apparatus according to a first embodiment of the present disclosure.

As shown in FIG. 1, the image forming apparatus 10 includes an ADF 1, an image reading portion 2, an image forming portion 3, a sheet feed portion 4, and an operation display portion 5. The image forming apparatus 10 is a multifunction peripheral having a plurality of functions such as a printer function to form an image on the basis of image data as well as a scanning function, a facsimile function, a copy function, or the like. In addition, the present disclosure is applicable to image forming apparatuses such as a printer apparatus, a facsimile apparatus, and a copy machine.

The ADF 1 is an automatic document feeder which includes a document set portion, a plurality of conveying rollers, a document holder, and a sheet discharge portion, which are not shown, and conveys a document sheet to be read by the image reading portion 2. The image reading portion 2 includes a document table, a light source, and a plurality of mirrors, an optical lens, and a CCD, which are not shown, and is capable of reading image data from a document sheet.

The operation display portion 5 includes: a display portion, such as a liquid crystal display, which displays various kinds of information in accordance with control instructions from a control portion which is not shown; and an operation portion, such as an operation key or a touch panel, which inputs various kinds of information into the control portion in accordance with user operations.

Figure 2:
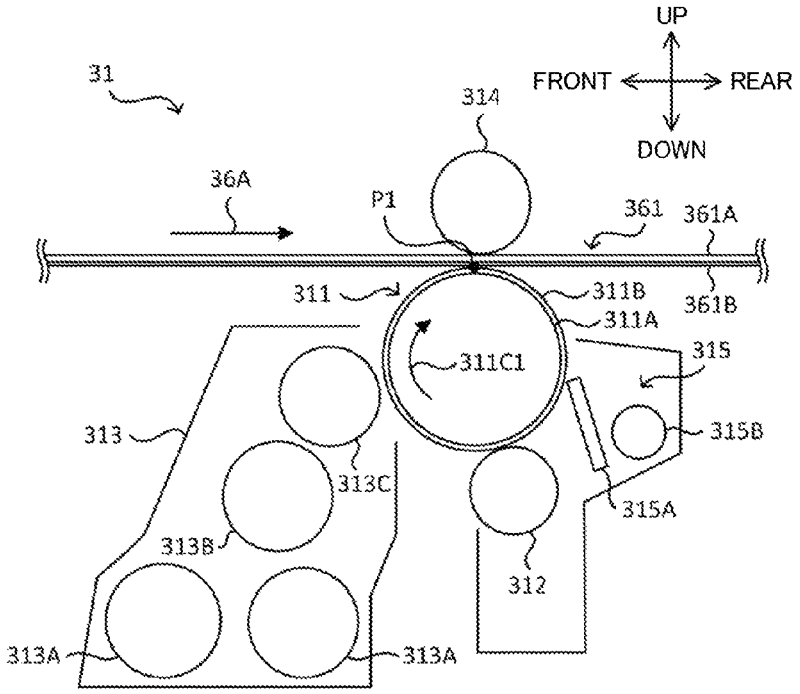
FIG. 2 is a diagram showing the configuration of an image forming unit of the image forming apparatus according to the first embodiment of the present disclosure.
Figure 3:
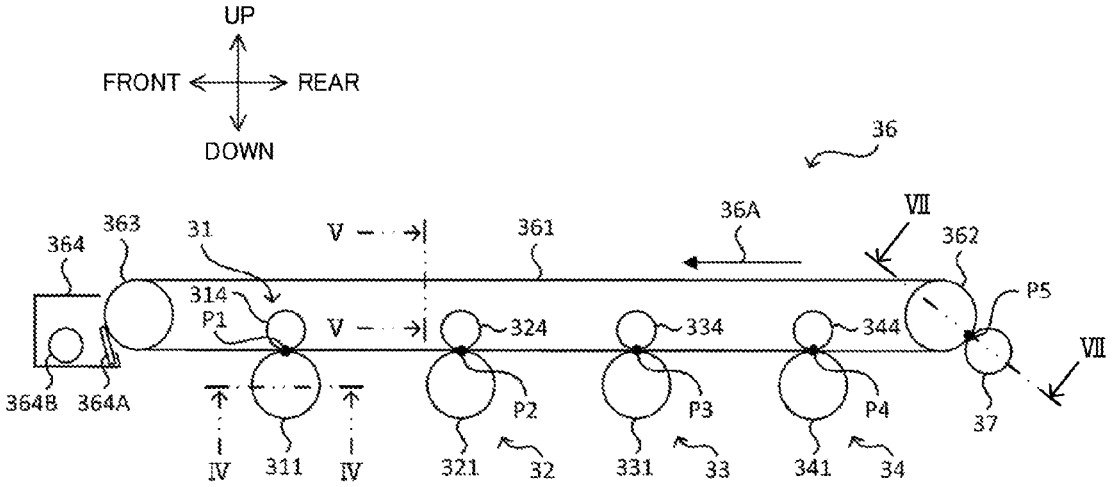
FIG. 3 is a diagram showing the configuration of an intermediate transfer device of the image forming apparatus according to the first embodiment of the present disclosure.

Next, the image forming portion 3 will be described with reference to FIGS. 1 to 3. Here, FIG. 2 is a schematic cross-sectional view showing the configuration of an image forming unit 31. FIG. 3 is a schematic cross-sectional view showing the configuration of an intermediate transfer device 36.

The image forming portion 3 is capable of executing an image forming process (printing process) of forming a color or monochrome image by electrophotography on the basis of image data read by the image reading portion 2. In addition, the image forming portion 3 is also capable of executing the printing process on the basis of image data inputted from an information processing apparatus such as an external personal computer.

Specifically, as shown in FIG. 1, the image forming portion 3 includes a plurality of image forming units 31 to 34, laser scanning units 35A and 35B, the intermediate transfer device 36, a secondary transfer roller 37, a fixing device 38, and a sheet discharge tray 39.

The image forming unit 31 is an electrophotographic type image forming unit corresponding to Y (yellow), the image forming unit 32 is an electrophotographic type image forming unit corresponding to C (cyan), the image forming unit 33 is an electrophotographic type image forming unit corresponding to M (magenta), and the image forming unit 34 is an electrophotographic type image forming unit corresponding to K (black). As shown in FIG. 1, the image forming units 31 to 34 are provided so as to be aligned along the front-rear direction of the image forming apparatus 10 in order of yellow, cyan, magenta, and black from the front of the image forming apparatus 10.

As shown in FIGS. 1 and 2, the image forming unit 31 includes a photosensitive drum 311, a charging roller 312, a developing device 313, a primary transfer roller 314, and a drum cleaning portion 315.

An electrostatic latent image is formed on the surface of the photosensitive drum 311. In addition, the photosensitive drum 311 carries a toner image on the surface thereof. Here, the photosensitive drum 311 is an example of an image carrier in the present disclosure.

Specifically, as shown in FIG. 2, the photosensitive drum 311 includes a base portion 311A and a photosensitive layer portion 311B. For example, the base portion 311A is an element tube made of aluminum. The photosensitive layer portion 311B is formed by coating, on the surface of the base portion 311A, an organic photosensitive material composed of an organic compound that improves conductivity when being irradiated with light. The method for forming the photosensitive layer portion 311B will be described later. The photosensitive drum 311 rotates along a rotation direction 311C1 shown in FIG. 2 upon reception of a driving force supplied from a power source which is not shown.

The charging roller 312 charges the photosensitive layer portion 311B of the photosensitive drum 311 at a potential having predetermined polarity. For example, the charging roller 312 charges the photosensitive layer portion 311B at a potential having plus polarity. Here, the charging roller 312 is an example of a charging portion in the present disclosure. The charging roller 312 may charge the photosensitive layer portion 311B at a potential having minus polarity.

For example, as shown in FIG. 2, the charging roller 312 is provided in contact with the photosensitive layer portion 311B. A voltage having plus polarity is applied to the charging roller 312 from a power supply device which is not shown. Accordingly, a discharge occurs between the charging roller 312 and the photosensitive layer portion 311B to charge the photosensitive layer portion 311B with plus polarity.

The developing device 313 develops an electrostatic latent image formed on the photosensitive layer portion 311B of the photosensitive drum 311, by using yellow toner charged with the same polarity as the charge polarity of the photosensitive layer portion 311B. Here, the developing device 313 is an example of a developing portion in the present disclosure.

Specifically, the developing device 313 includes an agitating screw 313A, a magnet roller 313B, and a developing roller 313C. A developer including toner and a carrier is contained within a housing of the developing device 313. The developer is agitated by the agitating screw 313A. Thus, the toner included in the developer becomes triboelectrically charged with plus polarity. The magnet roller 313B acquires the developer agitated by the agitating screw 313A and supplies the toner included in the developer, to the developing roller 313C. The developing roller 313C acquires the toner supplied from the magnet roller 313B and supplies the toner to the photosensitive layer portion 311B. The yellow toner is supplied from a toner container 313D shown in FIG. 1 to the developing device 313.

A voltage having polarity opposite to the charge polarity of the photosensitive layer portion 311B is applied to the primary transfer roller 314, and the primary transfer roller 314 transfers a toner image developed on the surface of the photosensitive layer portion 311B, onto a surface layer portion 361B of an intermediate transfer belt 361 of the intermediate transfer device 36. Here, the primary transfer roller 314 is an example of a transfer portion in the present disclosure.

Specifically, as shown in FIG. 2, the primary transfer roller 314 is opposed to the photosensitive layer portion 311B of the photosensitive drum 311 across the intermediate transfer belt 361. A voltage having minus polarity is applied to the primary transfer roller 314 from the power supply device which is not shown. Accordingly, an electric field is formed between the primary transfer roller 314 and the photosensitive layer portion 311B to transfer the toner image formed on the surface of the photosensitive layer portion 311B, onto the surface of the surface layer portion 361B of the intermediate transfer belt 361.

The drum cleaning portion 315 removes the toner remaining on the surface of the photosensitive layer portion 311B of the photosensitive drum 311. For example, at the drum cleaning portion 315, the toner remaining on the surface of the photosensitive layer portion 311B is removed by a blade-like cleaning member 315A. Then, the toner removed by the cleaning member 315A is conveyed to a toner receiving container, which is not shown, by a conveyance screw 315B and collected therein.

The image forming units 32 to 34 have the same configuration as the image forming unit 31. That is, as shown in FIGS. 1 and 3, the image forming units 32 to 34 include photosensitive drums 321 to 341, primary transfer rollers 324 to 344, and toner containers 323D to 343D.

The photosensitive drums 311 to 341 of the image forming units 31 to 34 are an example of a plurality of image carriers in the present disclosure.

The laser scanning units 35A and 35B apply light to the respective photosensitive layer portions of the photosensitive drums 311 to 341 to form electrostatic latent images thereon. Here, the laser scanning units 35A and 35B is an example of a light irradiation portion in the present disclosure.

Specifically, as shown in FIG. 1, the laser scanning unit 35A is provided in corresponding relation to the photosensitive drums 311 and 321 of the image forming units 31 and 32. The laser scanning unit 35B is provided in corresponding relation to the photosensitive drums 331 and 341 of the image forming units 33 and 34. The laser scanning unit 35A applies light based on image data to the photosensitive layer portion 311B of the photosensitive drum 311 that has been charged by the charging roller 312. Accordingly, an electrostatic latent image corresponding to the image data is formed on the photosensitive layer portion 311B.

The intermediate transfer device 36 conveys a toner image transferred from the photosensitive drums 311 to 341 onto the intermediate transfer belt 361, by using the intermediate transfer belt 361. As shown in FIGS. 1 and 3, the intermediate transfer device 36 includes the intermediate transfer belt 361, a driving roller 362, an extending roller 363, and a belt cleaning portion 364.

The intermediate transfer belt 361 is an endless belt member onto which toner images formed on the respective photosensitive layer portions of the photosensitive drums 311 to 341 are transferred. Here, the intermediate transfer belt 361 is an example of an intermediate transfer medium and an image conveying portion in the present disclosure.

Specifically, as shown in FIG. 2, the intermediate transfer belt 361 includes a base layer portion 361A and a surface layer portion 361B. The base layer portion 361A is formed of a thermoplastic resin. For example, the thermoplastic resin is polycarbonate (PC), polyvinylidene fluoride (PVDF), nylon (PA), polybutylene terephthalate (PBT), or the like. The surface layer portion 361B is formed by coating a thermosetting resin having insulation properties, on the base layer portion 361A. For example, the thermosetting resin is polyimide (PI), polyamide imide (PAI), acrylic (AC), or the like. The method for forming the surface layer portion 361B will be described later.

As shown in FIGS. 1 and 3, the intermediate transfer belt 361 is extended by the driving roller 362 and the extending roller 363 which are disposed so as to be spaced apart from each other in the front-rear direction of the image forming apparatus 10. Specifically, the intermediate transfer belt 361 is extended in a state where the base layer portion 361A is in contact with the driving roller 362 and the extending roller 363. In addition, the primary transfer rollers 314 to 344 of the image forming units 31 to 34 are disposed in a state of being in contact with the base layer portion 361A of the intermediate transfer belt 361. Moreover, the respective photosensitive layer portions of the photosensitive drums 311 to 341 of the image forming units 31 to 34 are disposed in a state of being in contact with the surface layer portion 361B of the intermediate transfer belt 361.

The driving roller 362 is rotationally driven by a driving force supplied from the power source which is not shown, to cause the intermediate transfer belt 361 to run. Accordingly, as shown in FIGS. 1 to 3, the surface layer portion 361B of the intermediate transfer belt 361 is conveyed along a conveyance direction 36A which is the same as the front-rear direction of the image forming apparatus 10.

The conveyance direction 36A is an example of a predetermined direction in the present disclosure.

The belt cleaning portion 364 removes the toner remaining on the surface of the surface layer portion 361B of the intermediate transfer belt 361. For example, at the belt cleaning portion 364, the toner remaining on the surface of the surface layer portion 361B is removed by a blade-like cleaning member 364A. Then, the toner removed by the cleaning member 364A is conveyed to a toner receiving container, which is not shown, by a conveyance screw 364B and collected therein.

The secondary transfer roller 37 transfers the toner images attached to the surface of the surface layer portion 361B of the intermediate transfer belt 361, onto a sheet. The secondary transfer roller 37 is provided in contact with the surface layer portion 361B of the intermediate transfer belt 361. A voltage is applied to the secondary transfer roller 37 from a power supply device which is not shown. Accordingly, an electric field is formed between the secondary transfer roller 37 and the surface layer portion 361B to transfer the toner images attached to the surface of the surface layer portion 361B, onto the sheet.

The fixing device 38 melt and fixes the toner images transferred onto the sheet by the secondary transfer roller 37, on the sheet. For example, the fixing device 38 includes a fixing roller 38A and a pressure roller 38B. The fixing roller 38A is provided in contact with the pressure roller 38B, and heats the toner images transferred onto the sheet, to fix the toner images on the sheet. The pressure roller 38B pressurizes the sheet passing through a contact portion formed between the fixing roller 38A and the pressure roller 38B.

The sheet on which the toner images have been fixed by the fixing device 38 is discharged to the sheet discharge tray 39.

At the image forming portion 3, a color image is formed on a sheet supplied from the sheet feed portion 4, by the following procedure. The sheet is a sheet material such as paper, coated paper, a postcard, an envelope, an OHP sheet, or the like.

First, at the image forming unit 31, the surface of the photosensitive layer portion 311B of the photosensitive drum 311 is uniformly charged at a potential having plus polarity by the charging roller 312. Light based on image data is applied by the laser scanning unit 35A to the surface of the photosensitive layer portion 311B that has been charged by the charging roller 312. Accordingly, an electrostatic latent image corresponding to the image data is formed on the surface of the photosensitive layer portion 311B. The electrostatic latent image formed on the surface of the photosensitive layer portion 311B is developed (visualized) as a toner image by the yellow toner that is supplied from the developing device 313 and charged with plus polarity. That is, the toner supplied from the developing device 313 adheres to the surface of the photosensitive layer portion 311B within a region where the light is applied by the laser scanning unit 35A.

The yellow toner image formed on the surface of the photosensitive layer portion 311B is conveyed by the photosensitive drum 311 rotating along the rotation direction 311C1, to a primary transfer position P1 for primary transfer by the primary transfer roller 317. Here, as shown in FIG. 2, the primary transfer position P1 is a position at which the surface of the photosensitive layer portion 311B and the surface layer portion 361B of the intermediate transfer belt 361 are in contact with each other. At the primary transfer position P1, the toner image attached to the surface of the photosensitive layer portion 311B is subjected to action by the electric field formed between the primary transfer roller 314 and the photosensitive layer portion 311B by the voltage that is applied to the primary transfer roller 314 and has minus polarity. Accordingly, the yellow toner image formed on the surface of the photosensitive layer portion 311B is transferred onto the surface of the surface layer portion 361B of the intermediate transfer belt 361. The toner remaining on the surface of the photosensitive layer portion 311B is removed by the drum cleaning portion 315.

Next, also at the image forming units 32 to 34, toner images of the corresponding colors are formed on the surfaces of the respective photosensitive layer portions of the photosensitive drums 321 to 341 by the same processing procedure as in the image forming unit 31. Then, at primary transfer positions P2 to P4 shown in FIG. 3, the toner images of the corresponding colors formed on the surfaces of the respective photosensitive layer portions of the photosensitive drums 321 to 341 are transferred onto the surface of the surface layer portion 361B of the intermediate transfer belt 361 by the primary transfer rollers 324 to 344, respectively. Accordingly, the toner images of the corresponding colors formed on the photosensitive drums 311 to 341 are overlaid and transferred on the surface of the surface layer portion 361B in order of yellow, cyan, magenta, and black.

The toner images transferred onto the surface of the surface layer portion 361B by the image forming units 31 to 34 are conveyed by the intermediate transfer belt 361 running along the conveyance direction 36A, to a secondary transfer position P5 for secondary transfer by the secondary transfer roller 37. Here, as shown in FIG. 3, the secondary transfer position P5 is a position at which the intermediate transfer belt 361 and the secondary transfer roller 37 are in contact with each other. At the secondary transfer position P5, a nip portion is formed between the surface layer portion 361B of the intermediate transfer belt 361 and the secondary transfer roller 37. The secondary transfer roller 37 transfers the toner images attached to the surface of the surface layer portion 361B, onto a sheet that is supplied from the sheet feed portion 4 and passes through the secondary transfer position P5. Here, the secondary transfer roller 37 is an example of a transfer roller in the present disclosure. The secondary transfer position P5 is an example of a nip portion in the present disclosure. The sheet is an example of a transfer target medium in the present disclosure.

Thereafter, on the sheet onto which the toner images have been transferred, an image is formed by the toner images being melted and fixed by the fixing device 38. The sheet on which the image has been formed is discharged to the sheet discharge tray 39.

Next, the method for forming the photosensitive layer portion 311B of the photosensitive drum 311 will be described with reference to FIG. 4. Here, FIG. 4 is a cross-sectional view as seen from the direction of arrows IV-IV in FIG. 3.

In the image forming apparatus 10, the photosensitive layer portion 311B of the photosensitive drum 311 is formed by a ring coating method. Here, the ring coating method is a method in which, while a ring-shaped coating device or an object is moved in the vertical direction, a coating material emitted from the inner peripheral side of the coating device is applied to the surface of the object. The use of the ring coating method as the method for forming the photosensitive layer portion 311B of the photosensitive drum 311 allows the productivity of the photosensitive drum 311 to be improved as compared to the case of using another method such as a spray coating method, a blade coating method, or the like. Instead of the ring coating method, a dipping method may be used as the method for forming the photosensitive layer portion 311B of the photosensitive drum 311. Also in this case, it is possible to improve the productivity of the photosensitive layer portion 311B of the photosensitive drum 311 as compared to the case of using another method.

Figure 4:
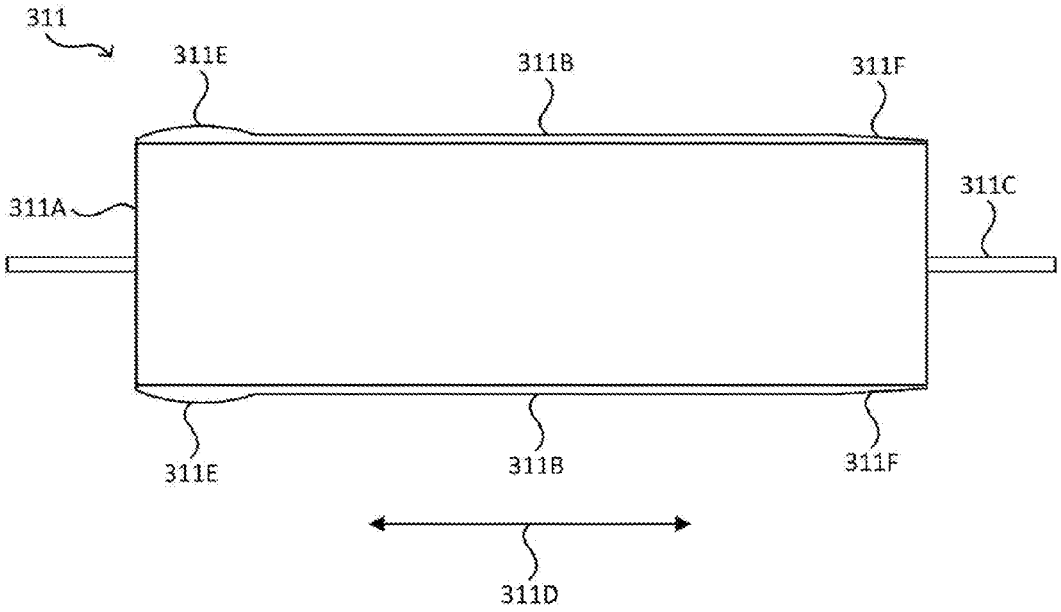
FIG. 4 is a diagram showing the configuration of a photosensitive drum of the image forming apparatus according to the first embodiment of the present disclosure.

In the case where the photosensitive layer portion 311B of the photosensitive drum 311 is formed by the ring coating method or the dipping method, the photosensitive layer portion 311B of the photosensitive drum 311 is formed such that the layer thickness of a first end portion 311E at one side in a rotational axis direction 311D of a rotation shaft 311C of the photosensitive drum 311 is larger than the layer thickness of a second end portion 311F at the other side in the rotational axis direction 311D as shown in FIG. 4. The shape of the photosensitive layer portion 311B of the photosensitive drum 311 is not limited to the shape in which the first end portion 311E bulges as shown in FIG. 4. For example, the shape of the photosensitive layer portion 311B of the photosensitive drum 311 may be a shape inclined linearly from the first end portion 311E toward the second end portion 311F.

Next, the method for forming the surface layer portion 361B of the intermediate transfer belt 361 will be described with reference to FIG. 5. Here, FIG. 5 is a cross-sectional view as seen from the direction of arrows V-V in FIG. 3.

In the image forming apparatus 10, similarly to the photosensitive layer portion 311B of the photosensitive drum 311, the surface layer portion 361B of the intermediate transfer belt 361 is formed by the ring coating method. The use of the ring coating method as the method for forming the surface layer portion 361B of the intermediate transfer belt 361 allows the productivity of the intermediate transfer belt 361 to be improved as compared to the case of using another method such as a spray coating method, a blade coating method, or the like. Instead of the ring coating method, a dipping method may be used as the method for forming the surface layer portion 361B of the intermediate transfer belt 361. Also in this case, it is possible to improve the productivity of the intermediate transfer belt 361 as compared to the case of using another method.

Figure 5:
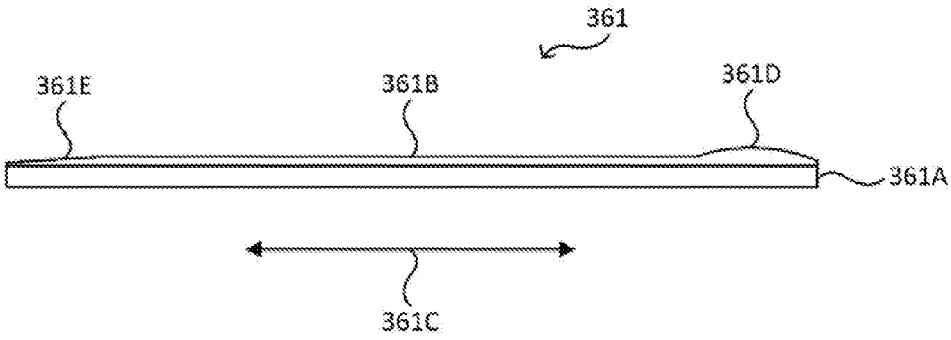
FIG. 5 is a diagram showing the configuration of an intermediate transfer belt of the image forming apparatus according to the first embodiment of the present disclosure.

In the case where the surface layer portion 361B of the intermediate transfer belt 361 is formed by the ring coating method or the dipping method, similarly to the photosensitive layer portion 311B of the photosensitive drum 311, the surface layer portion 361B of the intermediate transfer belt 361 is formed such that the layer thickness of a third end portion 361D at one side in a width direction 361C of the intermediate transfer belt 361 which is the same as the rotational axis direction 311D is larger than the layer thickness of a fourth end portion 361E at the other side in the width direction 361C as shown in FIG. 5. The shape of the surface layer portion 361B of the intermediate transfer belt 361 is not limited to the shape in which the third end portion 361D bulges as shown in FIG. 5. For example, the shape of the surface layer portion 361B of the intermediate transfer belt 361 may be a shape inclined linearly from the third end portion 361D toward the fourth end portion 361E.

The surface layer portion 361B of the intermediate transfer belt 361 is desirably formed of the thermosetting resin that has a Martens hardness of not less than 100 $N/mm^2$ and not greater than 350 $N/mm^2$. That is, in the case where the surface layer portion 361B of the intermediate transfer belt 361 is formed of the thermosetting resin that has a Martens hardness less than 100 $N/mm^2$, sufficient toner releasability is not obtained, so that the efficiency of transferring a toner image to a sheet decreases. In addition, in the case where the surface layer portion 361B of the intermediate transfer belt 361 is formed of the thermosetting resin that has a Martens hardness exceeding 350 $N/mm^2$, coating by the dipping method or the ring coating method becomes difficult.

Meanwhile, in the photosensitive layer portion 311B of the photosensitive drum 311, in the case where the photosensitive layer portion 311B is formed such that the layer thickness of the first end portion 311E is larger than the layer thickness of the second end portion 311F, an amount of electric charge stored in the second end portion 311F of the photosensitive layer portion 311B in charging by the charging roller 312 is larger than an amount of electric charge stored in the first end portion 311E. That is, in the case where the layer thickness of the second end portion 311F of the photosensitive layer portion 311B is smaller than the layer thickness of the first end portion 311E, the capacitance at the second end portion 311F is higher than the capacitance at the first end portion 311E. Thus, the amount of electric charge stored in the second end portion 311F of the photosensitive layer portion 311B is larger than the amount of electric charge stored in the first end portion 311E.

Here, in the image forming apparatus 10, in the case where development is performed by using toner charged with the same polarity as the charge polarity of the photosensitive layer portion 311B, in transfer by the primary transfer roller 314, a discharge may occur between the primary transfer roller 314 and a region on the photosensitive layer portion 311B which region is outside the region where the light is applied by the laser scanning unit 35A. In this case, through the second end portion 311F of the photosensitive layer portion 311B in which the amount of electric charge stored is larger than that in the first end portion 311E, a higher current flows than through the first end portion 311E. Thus, deterioration of the second end portion 311F of the photosensitive layer portion 311B advances more than that of the first end portion 311E. That is, by the current flowing through the photosensitive layer portion 311B, bond between the constituent elements of the above organic compound and the like which form the photosensitive layer portion 311B is weakened, so that the wear resistance decreases. If the photosensitive layer portion 311B deteriorates, wear of the photosensitive layer portion 311B due to contact with the cleaning member 315A advances.

On the other hand, in the surface layer portion 361B of the intermediate transfer belt 361, in the case where the surface layer portion 361B is formed such that the layer thickness of the third end portion 361D is larger than the layer thickness of the fourth end portion 361E, due to a discharge occurring between the photosensitive layer portion 311B and the primary transfer roller 314 in transfer by the primary transfer roller 314, a higher current flows through the photosensitive layer portion 311B opposed to the fourth end portion 361E of the surface layer portion 361B of the intermediate transfer belt 361, than through the photosensitive layer portion 311B opposed to the third end portion 361D of the surface layer portion 361B of the intermediate transfer belt 361. That is, at the intermediate transfer belt 361 interposed between the primary transfer roller 314 and the photosensitive layer portion 311B, an amount of electric charge flowing out from the photosensitive layer portion 311B due to the discharge occurring between the primary transfer roller 314 and the photosensitive layer portion 311B increases as the layer thickness of the surface layer portion 361B formed of the thermosetting resin having insulation properties decreases. Thus, deterioration of the second end portion 311F of the photosensitive layer portion 311B which second end portion 311F has a smaller layer thickness than the first end portion 311E of the photosensitive layer portion 311B may advance more than that of the first end portion 311E, so that the service life of the photosensitive drum 311 may be shortened.

Specifically, in the case where the intermediate transfer belt 361 is disposed such that the fourth end portion 361E of the surface layer portion 361B of the intermediate transfer belt 361 is opposed to the second end portion 311F of the photosensitive layer portion 311B of the photosensitive drum 311 and the third end portion 361D of the surface layer portion 361B is opposed to the first end portion 311E of the photosensitive layer portion 311B, deterioration of the second end portion 311F of the photosensitive layer portion 311B advances more than that of the first end portion 311E. Thus, in an image forming apparatus in which the third end portion 361D or the fourth end portion 361E of the surface layer portion 361B of the intermediate transfer belt 361 can be disposed at any of the one side and the other side in the rotational axis direction 311D of the photosensitive drum 311, if no attention is paid to a positional relationship between the third end portion 361D and the fourth end portion 361E of the surface layer portion 361B of the intermediate transfer belt 361 and the first end portion 311E and the second end portion 311F of the photosensitive layer portion 311B of the photosensitive drum 311 in assembling the intermediate transfer belt 361, the service life of the photosensitive drum 311 is varied in each individual image forming apparatus.

Figure 6:
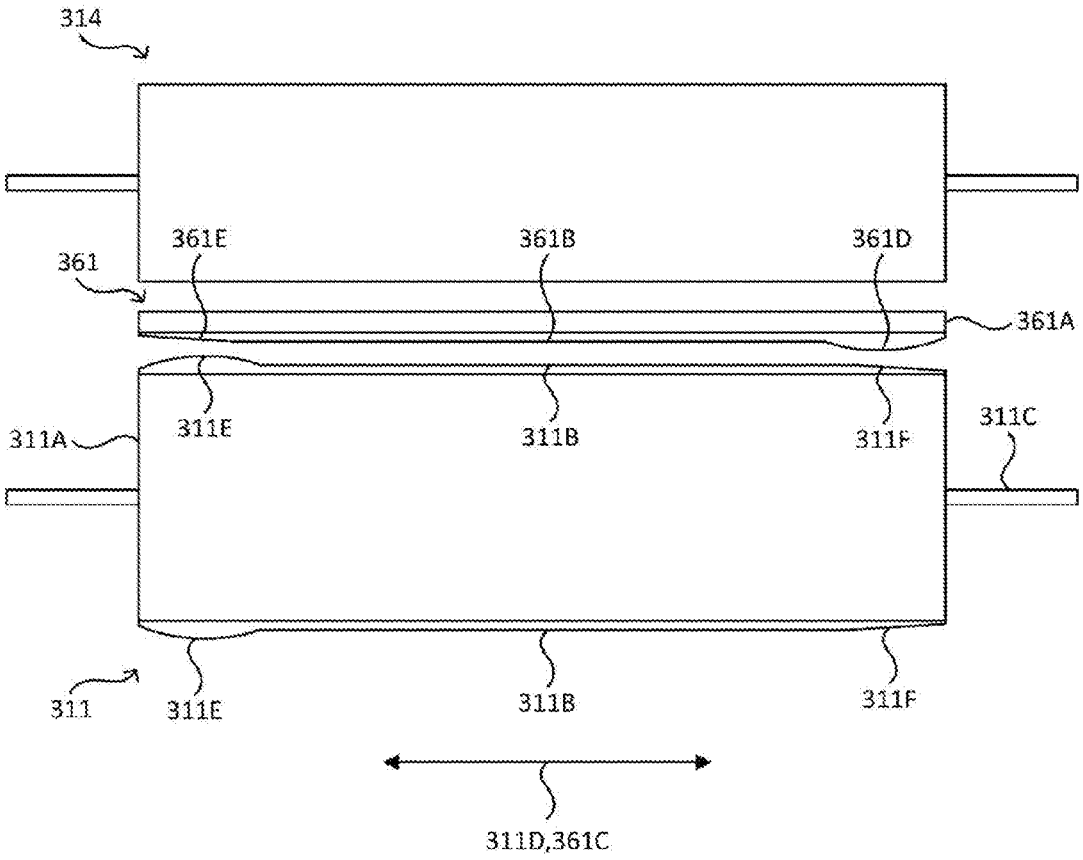
FIG. 6 is a diagram showing a positional relationship between the photosensitive drum and the intermediate transfer belt of the image forming apparatus according to the first embodiment of the present disclosure.

On the other hand, in the image forming apparatus 10 according to the present disclosure, as shown in FIG. 6, the fourth end portion 361E of the surface layer portion 361B of the intermediate transfer belt 361 is opposed to the first end portion 311E of the photosensitive layer portion 311B of the photosensitive drum 311, and the third end portion 361D of the surface layer portion 361B is opposed to the second end portion 311F of the photosensitive layer portion 311B. FIG. 6 is a side view from the left side on the sheet surface of FIG. 2, showing a positional relationship between the surface layer portion 361B of the intermediate transfer belt 361 and the photosensitive layer portion 311B of the photosensitive drum 311 at the primary transfer position P1 in FIG. 2. In FIG. 6, the primary transfer roller 314, the intermediate transfer belt 361, and the photosensitive drum 311 are disposed so as to be spaced apart from each other.

Thus, the fourth end portion 361E of the surface layer portion 361B is opposed to the first end portion 311E of the photosensitive layer portion 311B, and the third end portion 361D of the surface layer portion 361B, at which an amount of electric charge flowing out from the photosensitive layer portion 311B due to the discharge occurring between the primary transfer roller 314 and the photosensitive layer portion 311B is smaller than that at the fourth end portion 361E, is opposed to the second end portion 311F of the photosensitive layer portion 311B in which the amount of electric charge stored is larger than that in the first end portion 311E. Accordingly, it is possible to reduce the difference between an amount of the current flowing through the first end portion 311E of the photosensitive layer portion 311B and an amount of the current flowing through the second end portion 311F due to the discharge occurring between the primary transfer roller 314 and the photosensitive layer portion 311B. Therefore, advance of deterioration of the second end portion 311F of the photosensitive layer portion 311B is suppressed, so that the service life of the photosensitive drum 311 is lengthened. In addition, occurrence of variation of the service life of the photosensitive drum 311 in each individual image forming apparatus 10 is suppressed.

For the image forming apparatus 10 according to the embodiment of the present disclosure, an experiment was conducted as to whether image defects occur when 200 thousand sheets are printed consecutively. In the experiment, the photosensitive drum 311 in which the layer thickness of the first end portion 311E of the photosensitive layer portion 311B is 32 μm and the layer thickness of the second end portion 311F is 28 μm, and the intermediate transfer belt 361 in which the layer thickness of the third end portion 361D of the surface layer portion 361B formed of the thermosetting resin containing a polyimide resin as a principal component is 9 μm and the layer thickness of the fourth end portion 361E is 3.5 μm, were used. As a result of the experiment, occurrence of image defects was not confirmed.

On the other hand, in the image forming apparatus 10 used in the above experiment, the positional relationship between the photosensitive drum 311 and the intermediate transfer belt 361 was reversed, and the same experiment as the above experiment was conducted. That is, in the image forming apparatus 10 used in the above experiment, the fourth end portion 361E of the surface layer portion 361B of the intermediate transfer belt 361 was opposed to the second end portion 311F of the photosensitive layer portion 311B, the third end portion 361D was opposed to the first end portion 311E, and the same experiment as the above experiment was conducted. As a result, occurrence of image defects such as black spots appearing was confirmed when the number of the printed sheets exceeded 150 thousands. The reason for the occurrence of image defects is through to be that the second end portion 311F of the photosensitive layer portion 311B of the photosensitive drum 311 wore due to the consecutive printing.

Second Embodiment

Hereinafter, a second embodiment of the present disclosure will be described with reference to the accompanying drawings in order to allow understanding of the present disclosure. It should be noted that the following embodiment is an example embodying the present disclosure and does not limit the technical scope of the present disclosure. In the following embodiment, the components common to the first embodiment described above are designated by the reference numerals used in the first embodiment, and the description thereof is omitted.

Similarly as in the first embodiment described above, an image forming apparatus 10 according to the second embodiment of the present disclosure includes an ADF 1, an image reading portion 2, an image forming portion 3, a sheet feed portion 4, and an operation display portion 5 (see FIG. 1). In addition, the image forming portion 3 includes a plurality of image forming units 31 to 34, laser scanning units 35A and 35B, an intermediate transfer device 36, a secondary transfer roller 37, a fixing device 38, and a sheet discharge tray 39 (see FIG. 1). Each image forming unit 31 includes a photosensitive drum 311, a charging roller 312, a developing device 313, a primary transfer roller 314, and a drum cleaning portion 315 (see FIG. 2).

Figure 7:
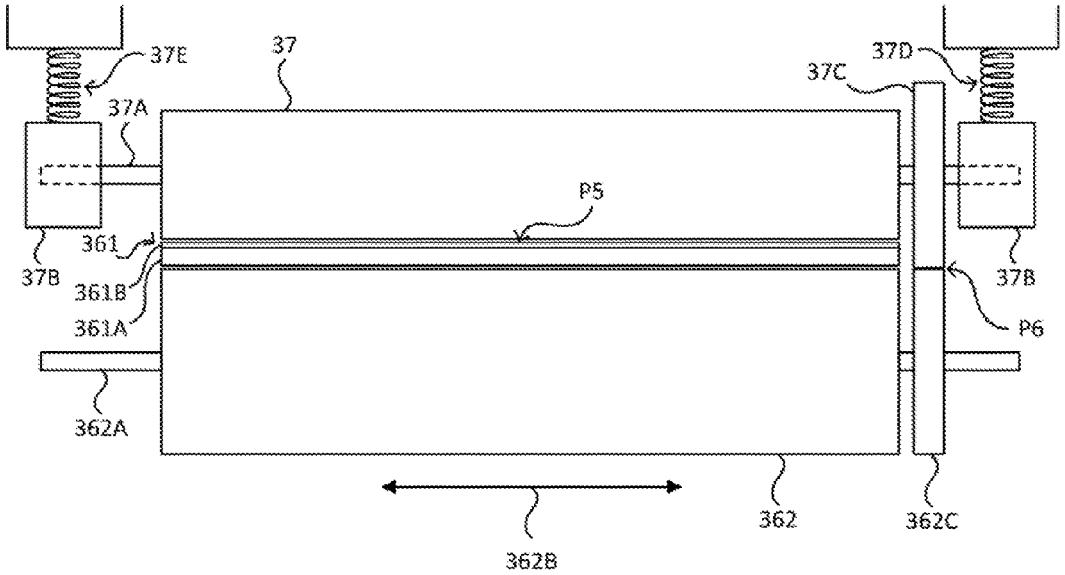
FIG. 7 is a diagram showing the configuration of a secondary transfer roller of an image forming apparatus according to a second embodiment of the present disclosure.
Figure 8:
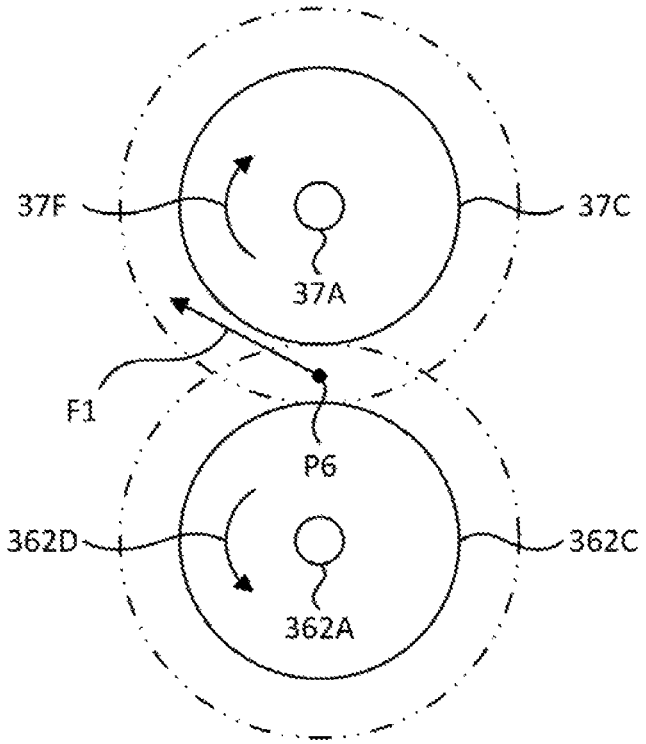
FIG. 8 is a diagram showing the configuration of a first gear and a second gear of the image forming apparatus according to the second embodiment of the present disclosure.

Next, the secondary transfer roller 37 will be described in detail with reference to FIGS. 3, 7, and 8. Here, FIG. 7 is a cross-sectional view as seen from the direction of arrows VII-VII in FIG. 3. FIG. 8 is a side view, from the right side on the sheet surface of FIG. 7, of a first gear 362C and a second gear 37C in FIG. 7. Alternate long and two short dashes lines in FIG. 8 indicate the teeth of the first gear 362C and the second gear 37C.

As shown in FIGS. 3 and 7, the secondary transfer roller 37 is provided at a position opposing the surface of the driving roller 362 across the surface layer portion 361B of the intermediate transfer belt 361. A rotation shaft 37A of the secondary transfer roller 37 is rotatably supported by bearings 37B provided on a housing of the image forming apparatus 10 that houses the components of the image forming portion 3, and the secondary transfer roller 37 rotates upon reception of a driving force supplied from the driving roller 362.

Specifically, as shown in FIG. 7, the first gear 362C is provided at one side of a rotation shaft 362A of the driving roller 362 in a rotation shaft direction 362B of the rotation shaft 362A. The first gear 362C rotates along a rotation direction 362D shown in FIG. 8, upon reception of a rotational driving force transmitted from the driving roller 362.

Meanwhile, as shown in FIG. 7, the second gear 37C which can mesh with the first gear 362C is provided on the rotation shaft 37A of the secondary transfer roller 37 and at a position opposing the first gear 362C so as to be in mesh with the first gear 362C. At a mesh portion P6 where the second gear 37C is in mesh with the first gear 362C, the second gear 37C transmits a rotational driving force transmitted from the first gear 362C, to the secondary transfer roller 37. Accordingly, the secondary transfer roller 37 rotates along a rotation direction 37F shown in FIG. 8, upon reception of the driving force supplied from the driving roller 362. By interlocking rotation of the secondary transfer roller 37 with rotation of the driving roller 362, a decrease in transferability due to rotation of the secondary transfer roller 37 being made unstable by, for example, friction generated between a sheet and the secondary transfer roller 37 when the sheet passes through the secondary transfer position P5 is suppressed.

The secondary transfer roller 37 is biased toward the driving roller 362 in order to obtain, at the secondary transfer position P5, a nip pressure required for transfer.

Specifically, the bearings 37B are provided on the housing so as to be movable in a direction toward and away from the driving roller 362. The bearing 37B that supports the rotation shaft 37A at the side at which the second gear 37C is provided is biased toward the driving roller 362 by a first biasing member 37D. Meanwhile, the bearing 37B that supports the rotation shaft 37A at the side at which the second gear 37C is not provided is biased toward the driving roller 362 by a second biasing member 37E. For example, each of the first biasing member 37D and the second biasing member 37E is a coil spring which is provided such that an end portion thereof at one side in a longitudinal direction thereof is supported by the housing and an end portion thereof at the other side in the longitudinal direction thereof is in contact with the bearing 37B.

Meanwhile, in the case where the secondary transfer roller 37 is rotationally driven by a driving force transmitted from the driving roller 362 via the first gear 362C and the second gear 37C, when a sheet passes through the secondary transfer position P5, the nip pressure at the side in the rotation shaft direction 362B on the secondary transfer position P5 at which side the first gear 362C and the second gear 37C are provided is lower than the nip pressure at the side in the rotation shaft direction 362B on the secondary transfer position P5 at which side the first gear 362C and the second gear 37C are not provided. Hereinafter, for convenience of explanation, the side in the rotation shaft direction 362B of the driving roller 362 at which side the first gear 362C and the second gear 37C are provided is referred to as "gear-provided side". The side in the rotation shaft direction 362B at which side the first gear 362C and the second gear 37C are not provided is referred to as "non-provided side".

Specifically, a rotational load of the secondary transfer roller 37 increases due to, for example, friction generated between the sheet and the secondary transfer roller 37 when the sheet passes through the secondary transfer position P5. Meanwhile, as shown in FIG. 8, a force F1 applied to the teeth of the second gear 37C at the mesh portion P6 when a rotational driving force is transmitted from the first gear 362C to the second gear 37C includes a component of force applied in a direction in which the second gear 37C is separated from the first gear 362C. Thus, when the rotational load increases and the force F1 applied from the first gear 362C to the second gear 37C increases, the force applied at the mesh portion P6 in the direction in which the second gear 37C is separated from the first gear 362C also increases. Therefore, the nip pressure decreases at the gear-provided side in the rotation shaft direction 362B on the secondary transfer position P5. In particular, in the case where the sheet is thick paper, the degree of decrease in the nip pressure becomes high as compared to the case with plain paper, and a problem arises which is a decrease in transferability due to insufficient nip pressure at the gear-provided side in the rotation shaft direction 362B on the secondary transfer position P5.

Accordingly, in the image forming apparatus 10, the secondary transfer roller 37 is brought into contact with the surface layer portion 361B in a state where the contact pressure against the gear-provided side in the rotation shaft direction 362B on the surface layer portion 361B of the intermediate transfer belt 361 is higher than the contact pressure against the non-provided side in the rotation shaft direction 362B on the surface layer portion 361B.

Specifically, the second biasing member 37E biases the bearing 37B with a force smaller than that of the first biasing member 37D. For example, the biasing forces of the first biasing member 37D and the second biasing member 37E are set to appropriate values in accordance with the degree of decrease in the nip pressure at the gear-provided side in the rotation shaft direction 362B on the secondary transfer position P5 when the thick paper passes through the secondary transfer position P5. Accordingly, it is possible to eliminate the problem that is a decrease in transferability due to insufficient nip pressure when the thick paper passes through the secondary transfer position P5.

The method for bringing the secondary transfer roller 37 into contact with the surface layer portion 361B in a state where the contact pressure against the gear-provided side in the rotation shaft direction 362B on the surface layer portion 361B of the intermediate transfer belt 361 is higher than the contact pressure against the non-provided side in the rotation shaft direction 362B on the surface layer portion 361B, is not limited to the above-described method. For example, by disposing the secondary transfer roller 37 in a state where the rotation shaft 37A is inclined relative to the rotation shaft 362A of the driving roller 362, it is possible to make the contact pressure against the gear-provided side in the rotation shaft direction 362B on the surface layer portion 361B higher than the contact pressure against the non-provided side in the rotation shaft direction 362B on the surface layer portion 361B. In addition, by using the secondary transfer roller 37 having different roller diameters at both end portions in the rotation shaft direction of the rotation shaft 37A, it is possible to make the contact pressure against the gear-provided side in the rotation shaft direction 362B on the surface layer portion 361B higher than the contact pressure against the non-provided side in the rotation shaft direction 362B on the surface layer portion 361B.

The method for forming the surface layer portion 361B of the intermediate transfer belt 361 has been already described in the above first embodiment, and thus the description thereof is omitted here.

Incidentally, in the case where the secondary transfer roller 37 is provided so as to be brought into contact with the surface layer portion 361B in a state where the contact pressure against the gear-provided side in the rotation shaft direction 362B on the surface layer portion 361B of the intermediate transfer belt 361 is higher than the contact pressure against the non-provided side in the rotation shaft direction 362B on the surface layer portion 361B, the following problem arises. Specifically, when plain paper passes through the secondary transfer position P5, the nip pressure at the gear-provided side in the rotation shaft direction 362B on the secondary transfer position P5 becomes higher than the nip pressure at the non-provided side in the rotation shaft direction 362B on the secondary transfer position P5, wear due to friction with the plain paper at the gear-provided side in the rotation shaft direction 362B on the surface layer portion 361B advances more than at the non-provided side in the rotation shaft direction 362B on the surface layer portion 361B.

Meanwhile, in the case where the surface layer portion 361B of the intermediate transfer belt 361 is formed by the dipping method or the ring coating method, the layer thickness of the surface layer portion 361B at a first end portion 361D at one side in the width direction 361C of the intermediate transfer belt 361 is larger than the layer thickness of the surface layer portion 361B at a second end portion 361E at the other side in the width direction 361C as described above. Thus, wear of the surface layer portion 361B at the second end portion 361E of the intermediate transfer belt 361 advances more than at the first end portion 361D, so that the service life of the intermediate transfer belt 361 may be shortened.

Specifically, in the case where the intermediate transfer belt 361 is disposed such that the second end portion 361E of the intermediate transfer belt 361 is located at the gear-provided side in the rotation shaft direction 362B and the first end portion 361D is located at the non-provided side in the rotation shaft direction 362B, wear of the surface layer portion 361B advances at the second end portion 361E more than at the first end portion 361D. Thus, in an image forming apparatus in which the first end portion 361D or the second end portion 361E of the intermediate transfer belt 361 can be disposed at any of the gear-provided side and the non-provided side in the rotation shaft direction 362B, if no attention is paid to a positional relationship between the gear-provided side and the non-provided side in the rotation shaft direction 362B and the first end portion 361D and the second end portion 361E in assembling the intermediate transfer belt 361, the service life of the intermediate transfer belt 361 is varied in each individual image forming apparatus.

Figure 9:
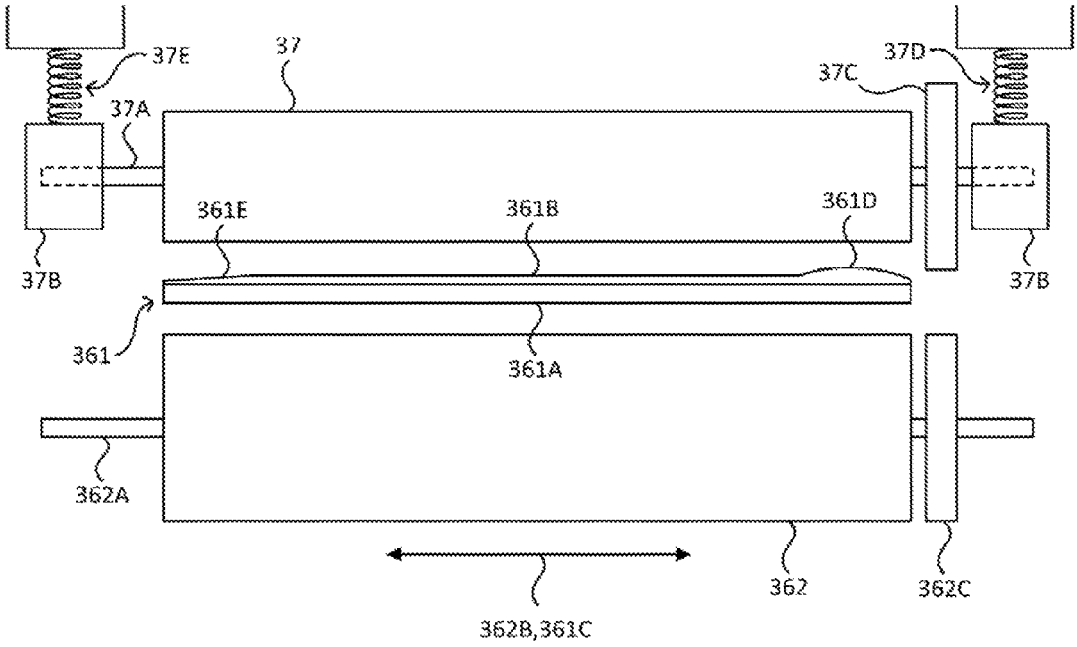
FIG. 9 is a diagram showing a positional relationship between the secondary transfer roller and an intermediate transfer belt of the image forming apparatus according to the second embodiment of the present disclosure.

On the other hand, in the image forming apparatus 10 according to the present disclosure, as shown in FIG. 9, the intermediate transfer belt 361 is disposed such that the second end portion 361E of the intermediate transfer belt 361 is located at the non-provided side in the rotation shaft direction 362B and the first end portion 361D is located at the gear-provided side in the rotation shaft direction 362B. It should be noted that FIG. 9 is a diagram in which the driving roller 362, the intermediate transfer belt 361, and the secondary transfer roller 37 in FIG. 7 are spaced apart from each other in order to explain the positional relationship between the first end portion 361D and the second end portion 361E of the intermediate transfer belt 361 and the gear-provided side and the non-provided side in the rotation shaft direction 362B.

Accordingly, the second end portion 361E is disposed at the non-provided side in the rotation shaft direction 362B, and the first end portion 361D having a larger layer thickness than the second end portion 361E is disposed at the gear-provided side in the rotation shaft direction 362B where the nip pressure becomes high when the plain paper passes through the secondary transfer position P5. That is, the first end portion 361D having higher durability against wear than the second end portion 361E is disposed at the gear-provided side in the rotation shaft direction 362B where wear of the surface layer portion 361B advances more than at the non-provided side in the rotation shaft direction 362B. Thus, the service life of the intermediate transfer belt 361 is lengthened. In addition, occurrence of variation of the service life of the intermediate transfer belt 361 in each individual image forming apparatus 10 is suppressed.

Hereinafter, a specific example according to the second embodiment will be described. For the image forming apparatus 10 according to the second embodiment, an experiment was conducted to check amounts of wear of the surface layer portion 361B at both end portions in the width direction 361C of the intermediate transfer belt 361. FIG. 10 shows the results of the experiment. In the experiment, 200 thousand sheets of plain paper each having 80 g were printed consecutively by using the image forming apparatus 10, and the layer thickness of the surface layer portion 361B of the intermediate transfer belt 361 was checked after the printing. In addition, in the experiment, the intermediate transfer belt 361 that includes the surface layer portion 361B formed of the thermosetting resin that contains a polyimide resin as a principal component and has a Martens hardness of about 180 $N/mm^2$, and the intermediate transfer belt 361 that includes the surface layer portion 361B formed of the thermosetting resin that contains an acrylic resin as a principal component and has a Martens hardness of about 250 $N/mm^2$, were used. In addition, the specifications of the image forming apparatus 10 in the experiment are as follows.

Specifically, as the base layer portion 361A of the intermediate transfer belt 361, one formed of the thermoplastic resin that contains a nylon resin as a principal component and has a Yong's modulus of about 1500 MPa was used. The driving roller 362 is composed of an aluminum three-arrow tube (a conductive rubber having a surface layer formed of EPDM, layer thickness: 1.0 mm), and the outer diameter thereof is 21 mm. The secondary transfer roller 37 is composed of epichlorohydrin rubber, the outer shape thereof has an outer diameter of 21 mm, and the inner diameter thereof is 10 mm. In addition, the hardness of the secondary transfer roller 37 is 38°±5° as a numeric value measured with a durometer (a spring type hardness meter) specified in the standards (SRIS) of THE SOCIETY OF RUBBER SCIENCE AND TECHNOLOGY, JAPAN. The biasing force of the first biasing member 37D is 20±1 [N], and the biasing force of the second biasing member 37E is 15±1 [N].

From the results of the experiment shown in FIG. 10, in the case where the surface layer portion 361B of the intermediate transfer belt 361 is formed of the thermosetting resin containing a polyimide resin as a principal component, it was found that the surface layer portion 361B of the intermediate transfer belt 361 wore in an amount of 2.5 μm at an end portion thereof disposed at the non-provided side in the rotation shaft direction 362B, and wore in an amount of 4.0 μm at an end portion thereof disposed at the gear-provided side in the rotation shaft direction 362B. In addition, in the case where the surface layer portion 361B of the intermediate transfer belt 361 is formed of the thermosetting resin containing an acrylic resin as a principal component, it was found that the surface layer portion 361B of the intermediate transfer belt 361 wore in an amount of 0.1 μm at an end portion thereof disposed at the non-provided side in the rotation shaft direction 362B, and wore in an amount of 0.2 μm at an end portion thereof disposed at the gear-provided side in the rotation shaft direction 362B.

From the above results of the experiment, it was found that, in the case where the surface layer portion 361B of the intermediate transfer belt 361 is formed by the dipping method or the ring coating method, the service life of the intermediate transfer belt 361 is lengthened by disposing the intermediate transfer belt 361 such that the second end portion 361E of the intermediate transfer belt 361 is located at the non-provided side in the rotation shaft direction 362B and the first end portion 361D having a larger layer thickness of the surface layer portion 361B than the second end portion 361E is located at the gear-provided side in the rotation shaft direction 362B, in assembling the intermediate transfer belt 361 to the image forming apparatus 10.

Modifications of Second Embodiment

In addition to an indirect-transfer-type image forming apparatus using the intermediate transfer belt 361 such as the image forming apparatus 10, the present disclosure may be applied to a direct-transfer-type image forming apparatus which directly transfers a toner image formed on the surface of the photosensitive layer portion 311B of the photosensitive drum 311, onto a sheet. Specifically, the present disclosure is applicable to the direct-transfer-type image forming apparatus in the case where, in the direct-transfer-type image forming apparatus: the photosensitive layer portion 311B of the photosensitive drum 311 is formed by the dipping method or the ring coating method; and the transfer roller that transfers a toner image supported on the photosensitive layer portion 311B of the photosensitive drum 311, onto a sheet passing through the nip portion formed between the photosensitive layer portion 311B and the transfer roller, rotates upon reception of a driving force from the photosensitive drum 311. In this case, the rotation shaft and the base portion 311A of the photosensitive drum are another example of a driving roller in the present disclosure. The photosensitive layer portion 311B is another example of a surface layer portion and the image conveying portion in the present disclosure.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an image carrier provided so as to be rotatable upon reception of a driving force and including a photosensitive layer portion having a first end portion at one side in a rotational axis direction and a second end portion at another side in the rotational axis direction, the first end portion having a larger layer thickness than the second end portion;

a charging portion configured to charge the photosensitive layer portion at a potential having predetermined polarity;

a light irradiation portion configured to apply light to the photosensitive layer portion charged by the charging portion, to form an electrostatic latent image thereon;

a developing portion configured to develop the electrostatic latent image formed on the photosensitive layer portion, by toner charged with the same polarity as the predetermined polarity;

an intermediate transfer medium including a surface layer portion having a third end portion at one side in a width direction which is the same as the rotational axis direction and a fourth end portion at another side in the width direction, the third end portion having a larger layer thickness than the fourth end portion, the third end portion being opposed to the second end portion of the photosensitive layer portion, the fourth end portion being opposed to the first end portion of the photosensitive layer portion; and a transfer portion opposed to the image carrier across the intermediate transfer medium and configured to transfer a toner image developed on a surface of the photosensitive layer portion, onto the surface layer portion of the intermediate transfer medium when a voltage having polarity opposite to the predetermined polarity is applied to the transfer portion.

2. The image forming apparatus according to claim 1, wherein the photosensitive layer portion is formed of an organic photosensitive material.

3. The image forming apparatus according to claim 1, wherein the surface layer portion is formed of an insulating resin.

4. The image forming apparatus according to claim 1, wherein either one of or both the photosensitive layer portion and the surface layer portion are formed by a dipping method or a ring coating method.

5. The image forming apparatus according to claim 1, wherein the intermediate transfer medium includes a base layer portion formed of a thermoplastic resin and the surface layer portion formed of a thermosetting resin.

6. The image forming apparatus according to claim 1, wherein the intermediate transfer medium is an endless belt member.

7. An image forming apparatus comprising:

a driving roller configured to rotate upon reception of a driving force;

an image conveying portion including a surface layer portion which supports a toner image thereon, the image conveying portion being formed such that a layer thickness of the surface layer portion is larger at a first end portion at one side in a rotation shaft direction of the driving roller than at a second end portion at another side in the rotation shaft direction, the image conveying portion being conveyed by the driving roller in a predetermined direction;

a transfer roller provided at a position opposing the driving roller across the surface layer portion of the image conveying portion, the transfer roller being brought into contact with the surface layer portion in a state where a contact pressure against the first end portion side on the surface layer portion is higher than a contact pressure against the second end portion side on the surface layer portion, the transfer roller being configured to transfer the toner image supported on the surface layer portion, onto a transfer target medium passing through a nip portion formed between the surface layer portion and the transfer roller;

a first gear provided at the first end portion side of the driving roller and configured to receive a rotational driving force transmitted from the driving roller; and a second gear provided at the first end portion side of the transfer roller and configured to transmit the rotational driving force transmitted via the first gear, to the transfer roller.

8. The image forming apparatus according to claim 7, further comprising:

a first biasing member configured to bias a bearing for a rotation shaft at the first end portion side of the transfer roller, toward the driving roller; and a second biasing member configured to bias a bearing for the rotation shaft at the second end portion side of the transfer roller, toward the driving roller with a force smaller than that of the first biasing member.

9. The image forming apparatus according to claim 7, further comprising one or a plurality of image carriers each configured to carry a toner image, wherein the image conveying portion is an intermediate transfer medium onto which the toner image is transferred from the one or the plurality of image carriers.

10. The image forming apparatus according to claim 9, wherein the intermediate transfer medium includes a base layer portion formed of a thermoplastic resin and the surface layer portion formed of a thermosetting resin.

11. The image forming apparatus according to claim 9, wherein the intermediate transfer medium is an endless belt member.

12. The image forming apparatus according to claim 7, wherein the surface layer portion is formed by a dipping method or a ring coating method.

* * * * *